United States Patent [19]

Eide et al.

[11] 4,040,263

[45] Aug. 9, 1977

[54] ARRANGEMENT IN OR RELATING TO DRAINAGE

[75] Inventors: Ove Eide; Carl F. Clausen, both of Oslo, Norway

[73] Assignee: A/S Hoyer-Ellefsen, Oslo, Norway

[21] Appl. No.: 513,285

[22] Filed: Oct. 9, 1974

[30] Foreign Application Priority Data

Oct. 11, 1973 United Kingdom ..... 47568/73

[51] Int. Cl.[2] ..... E02D 21/00

[52] U.S. Cl. ..... 61/86; 61/98; 61/99

[58] Field of Search ..... 61/64, 46.5, 46, 86–104

[56] References Cited

U.S. PATENT DOCUMENTS

| | | | |
|---|---|---|---|
| 483,697 | 10/1892 | Rich | 61/64 |
| 2,865,179 | 12/1958 | McNeill | 61/46.5 |
| 2,895,301 | 7/1959 | Casagrande et al. | 61/46.5 |
| 3,001,370 | 9/1961 | Templeton | 61/46.5 |
| 3,412,563 | 11/1968 | Sharp | 61/53.74 X |

FOREIGN PATENT DOCUMENTS

| | | | |
|---|---|---|---|
| 1,088,804 | 10/1967 | United Kingdom | 61/46 |

*Primary Examiner*—Dennis L. Taylor
*Attorney, Agent, or Firm*—Larson, Taylor and Hinds

[57] ABSTRACT

A method of construction on natural or artificial soils subject to liquefaction involves the provision of one or more permeable wells penetrating the soil supporting a structure, such that excess water pressures induced by cyclic loads on the structure can be relieved. Pumps can be used to maintain the water pressure in the wells lower than the natural water pressure in the surrounding soil. The wells may be filled with water-permeable material. Structures in accordance with the invention can be of various forms, wherein drainage may be through one or more dowels or through a cushion on the lower section of the structure or structures.

2 Claims, 6 Drawing Figures

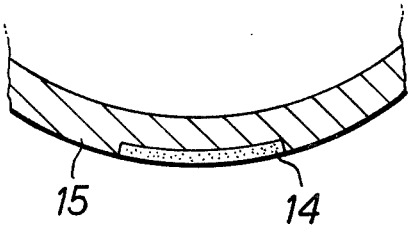
FIG. 4.
FIG. 5.
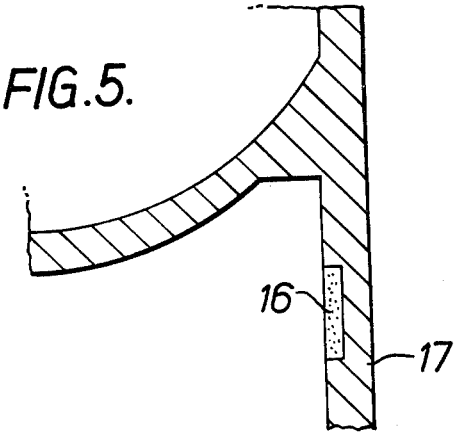
FIG. 6.
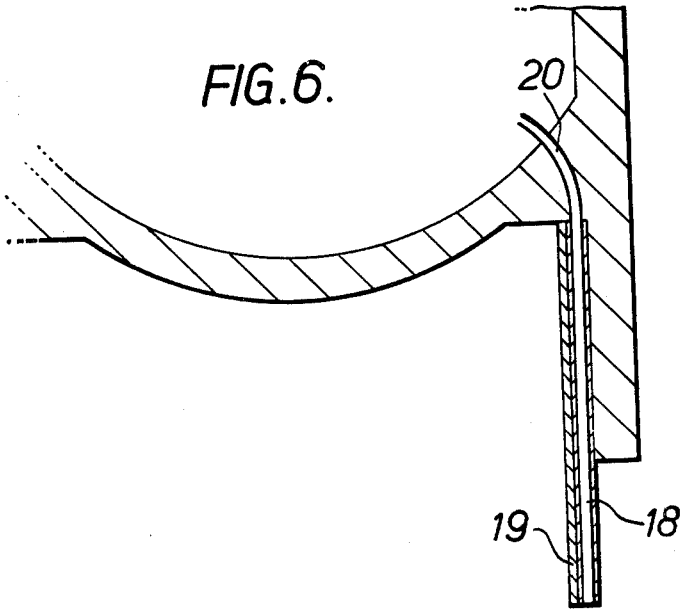

ARRANGEMENT IN OR RELATING TO DRAINAGE

The present invention relates in general to the founding of marine structures and more particularly, but not exclusively, the invention relates to supports for marine gravity type structures which are placed on the sea bed.

It has previously been well known to place a caisson on the sea floor with the purpose of serving for example as a storage reservior or a foundation element for a platform.

Due to environmental forces, the caisson can be subjected to a phenomenon called liquefaction. This phenomenon is best known in loose sand - or silt depositions with uniform grain size distribution. If cyclic shearstresses are applied to such material, a gradual increase of the pore water pressure may occur. If the increase of the pore water pressure becomes large enough, and this excess pore water pressure is not relieved fast enough a failure in the soil will occur (liquefaction). The sand or silt will more or less behave as a liquid until the excess pore water pressure is relieved. The most commonly known sources of cyclic shearstresses giving liquefaction are waves and earthquakes. It should also be noted that windloads, in extreme cases, may cause cyclic shear loads. The shear loads may be transferred to the soil via structure or its support or directly on to the soil through earthquake activities or waveloads.

The present invention is intended to counteract the above mentioned phenomenon. According to the present invention this is achieved by the installation of one or more wells in the sea floor beneath the marine structure. These wells will allow the excess pore water pressure to be relieved. The wells are permeable and allow water to flow easily through. To avoid plugging of the wells, the material in the wells should form a filter with respect to the surrounding soils. The effect of such wells can be considerably increased by lowering the water pressure therein compared to the natural water pressure in the surrounding soil. This will generally lead to consolidation and increased effective stresses in the surrounding soils.

The present invention provides a base for a structure on a natural or artificial sea bed subjected to the phenomenon of liquefraction, comprising one or more permeable wells penetrating the supporting soil such that excess water pressures induced by the cyclic loads on the structure may be relieved.

The present invention also provides a method of construction on natural or artificial soil subjected to the phenomenon of liquefraction comprising provision of one or more permeable wells penetrating the soil supporting the structure and temporarily or permanently keeping the water pressure in the well or wells lower than the natural water pressure in the surrounding soil.

The excessive pore water may be pumped out of the well by means of for example conventional pumps etc.

Embodiments of the invention will now be described by way of example only, with reference to the accompanying drawings, in which:

FIG. 4 shows a third embodiment of the present invention;

FIG. 5 shows a forth embodiment of the present invention; and finally

FIG. 6 shows a fifth embodiment of the present invention.

Figure 1:
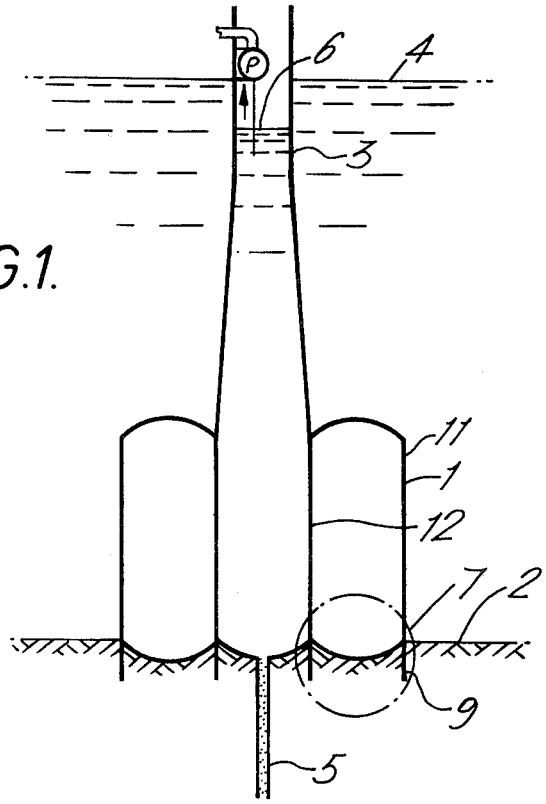
FIG. 1 shows in elevation a sketch of a gravity type structure resting on the sea bed.

Referring to FIG. 1 there is shown a caisson 1, resting on the sea floor 2. A tower 3, is extended to above the sea level 4. A well 5 has been made in the ground for example by drilling, with or without a casing. A drainage filter is installed in the well. The volume of water to be drained away from the soil underneath the structure can now flow into the well 5, and be removed in conventional manner, for example by a pump, through the caisson and out into the open sea. Accordingly, in the embodiment shown in FIG. 1, the water level inside the caisson can be kept at a lower level 6, than the water level 4, outside by for example pumping by a pump shown schematically in FIG. 1. The soil underneath the caisson is thereby subjected to a lower pressure inside the well than outside, which will improve the effect of the drainage and make the soil better suited to carry the structure.

Figure 3:
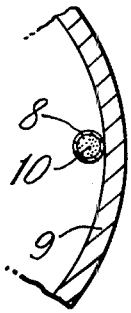
FIG. 3 shows a horizontal section along lines 3 — 3 of the structure in FIG. 2.
Figure 2:
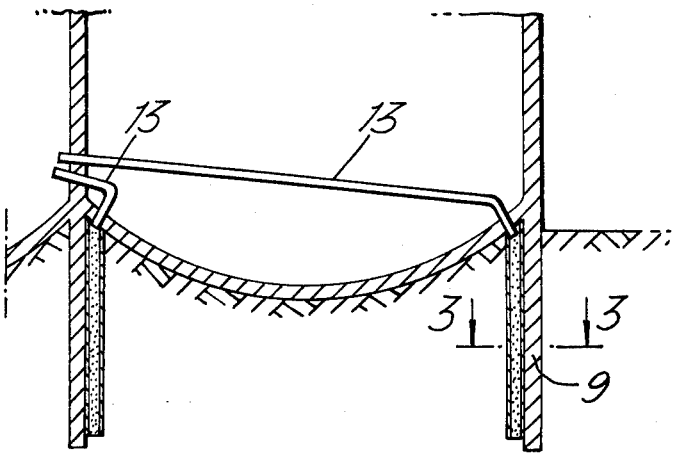
FIG. 2 shows a vertical section on larger scale of part of the structure shown in FIG. 1.

A further embodiment of the present invention as applied to structures resting on the sea bed is shown on FIG. 2. This figure is a detail of the encircled part 7, of the caisson shown in FIG. 1. FIG. 3 shows a horizontal partsection of FIG. 2 in direction 3 — 3. The drainage wells are fixed to the skirt which is penetrated into the supporting soil. The wells are connected with the caisson in the same way as the well 5. FIGS. 1 and 2 show the caisson divided into several cells 11, 12. The wells 10 may then have the same pressure as the well 5, if the wells 10 are connected to the central cell 12 by means of tubing 13.

FIG. 1 shows a platform of the "Condeep"-type, the platform being formed of a caisson consisting of a number of cells, a superstructure being formed by lengthening some of the cells in the caisson above the sea level and finally a base being formed of one or more skirts which are paressed down into the supporting soil. Further, the lower wall of each cell is formed as a spherical shell. It should be noted, however, that the present invention is not limited to the platform shown.

FIG. 4 shows a third embodiment of the present invention, where the drainage unit is founded as a cushion 14, on the lower section of the lower domes 15 of the cells. The tube connecting the cushion with the caisson is not shown.

FIG. 5 shows a fourth embodiment of the present invention.

According to this embodiment, the drainage unit is formed as a horizontal ring 16 along the inside wall 7 of the skirt. The tube connecting the ring with the caisson is not shown.

FIG. 6 shows a fifth embodiment of the present invention. According to this embodiment the drainage unit is fitted inside the dowels 19. The drainage unit is connected to the caisson through tubes 20.

According to the present invention the platform may be equipped with a deep central well as shown on FIG. 1 and/or one or more of the drainage units shown on FIGS. 2 - 6.

We claim:

1. In a fully positioned marine gravity-type structure surrounded by the sea so as to be subject to cyclic loads from environmental forces and resting firmly on the seabed at a predetermined ultimate depth and orientation and at a location where the seabed material is of substantially uniform grain size distribution, continuously available means for counteracting liquefaction in the supporting soil beneath the structure at any desired time by relieving excess pore water pressure arising at any time from cyclic shearload in the supporting soil, said means comprising one or more permeable wells penetrating said supporting soil, a water-tight open-topped tower extending from the seabed to above the water surface, means communicating said wells with the lower portion of said tower, and continuously available means for selectively maintaining the water level inside said tower at a lower level than the water surface so as to maintain a lower hydrostatic pressure inside said wells than outside, and hence relieve excess pore water pressure occuring at any time in the supporting soil about said wells.

2. A method of construction on undersea soils subject to the phenomenon of liquefaction, using a marine gravity-type structure as claimed in Claim 10, comprising positioning and supporting said structure on the seabed at and in a predetermined ultimate depth and orientation such that said structure is in its ultimate operational position and orientation, and thereafter selectively varying the water level inside said tower during the post-positioning operational life of said structure to relieve excess pore water pressure occurring at any time in the supporting soil about said wells.

* * * * *